US006543950B1

(12) United States Patent
Huang

(10) Patent No.: US 6,543,950 B1
(45) Date of Patent: Apr. 8, 2003

(54) HAND-CONTROLLED BACK BRUSH

(76) Inventor: Yung-Kuang Huang, No.75, Chi-Tsu St., Shulin City, Taipei Shieng (TW)

( * ) Notice: Subject to any disclaimer, the term of this patent is extended or adjusted under 35 U.S.C. 154(b) by 0 days.

(21) Appl. No.: 10/040,482

(22) Filed: Jan. 9, 2002

(51) Int. Cl.[7] ..... A46B 5/02
(52) U.S. Cl. ..... 401/6; 401/184; 401/183; 401/205; 401/207
(58) Field of Search ..... 401/6, 183, 184, 401/185, 207, 196, 205

(56) References Cited

U.S. PATENT DOCUMENTS 6,009,887 A * 1/2000 Hertel ..... 401/6
6,129,469 A * 10/2000 Messer et al. ..... 401/6
6,250,833 B1 * 6/2001 Perry et al. ..... 401/6

* cited by examiner

*Primary Examiner*—David J. Walczak
(74) *Attorney, Agent, or Firm*—Dennison, Schultz & Dougherty

(57) ABSTRACT

A hand-controlled back brush includes a handle and an arm portion that are rotatably connected to each other at their respective bevel front end and bevel rear end, so that the handle could be rotated relative to the arm portion within the range from zero to 180 degrees to shift from a position in alignment with the arm portion to a desired angular position relative to the arm portion for easy brushing of a user's back. The hand-controlled back brush is also provided with a bath cream container that is conveniently compressible with a thumb to supply a controlled amount of bath cream to a sponge fixed to a front end of the back brush.

5 Claims, 4 Drawing Sheets

HAND-CONTROLLED BACK BRUSH

FIELD OF THE INVENTION

The present invention relates to a hand-controlled back brush, and more particularly to a back brush having handle and arm portion that could be rotated relative to each other to contain between them an angle most suitable for easy brushing of a user's back, and having a bath cream container provided in the arm portion and compressible with a thumb to supply a controlled amount of bath cream to a sponge holder connected to a front end of the arm portion.

BACKGROUND OF THE INVENTION

Most people have the same experience that it is uneasy to brush and clean a whole back area simply with two hands when taking a bath. The two hands could normally reach only an upper and a lower part of the back but not a middle area thereof. Thus, people usually diagonally extend a wet towel applied with soap or bath cream across the back and grip at two ends of the towel to brush the back hard. This manner of cleaning back is inconvenient and usually consumes increased amount of bath cream or soap.

It is therefore tried by the inventor to develop a hand-controlled back brush to enable comfortable and effective cleaning of the back.

SUMMARY OF THE INVENTION

A primary object of the present invention is to provide a hand-controlled back brush that mainly includes a handle, an arm portion in front of the handle, a bath cream container fitted in the arm portion, and a sponge holder connected to a front end of the arm portion for holding a sponge thereto.

The handle is provided at a rear end with antislip strips, and at a front end with a bevel surface having a central recess. The arm portion is provided at a rear end with a bevel surface having a central projection fitly engaged into the central recess on the handle. Thus, the handle is rotatable relative to the arm portion about the engaged central recess and projection between zero and 180 degrees to shift from a position aligned with the arm portion to an angular position relative to the arm portion. A user may easily adjust the handle to an angular position best for brushing the back easily.

The sponge holder of the hand-controlled back brush of the present invention defines an internal passage that extends from an open rear end of the sponge holder connected to the bath cream container to a bath cream outlet at a front edge of the sponge holder. When the bath cream container is compressed with a thumb, a controlled amount of bath cream is supplied from the container through the internal passage to the bath cream outlet and wet the sponge fixed to the sponge holder. The amount being supplied to the sponge each time may be controlled by the force applied on the bath cream container with the thumb and the number of times of compressing the bath cream container.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
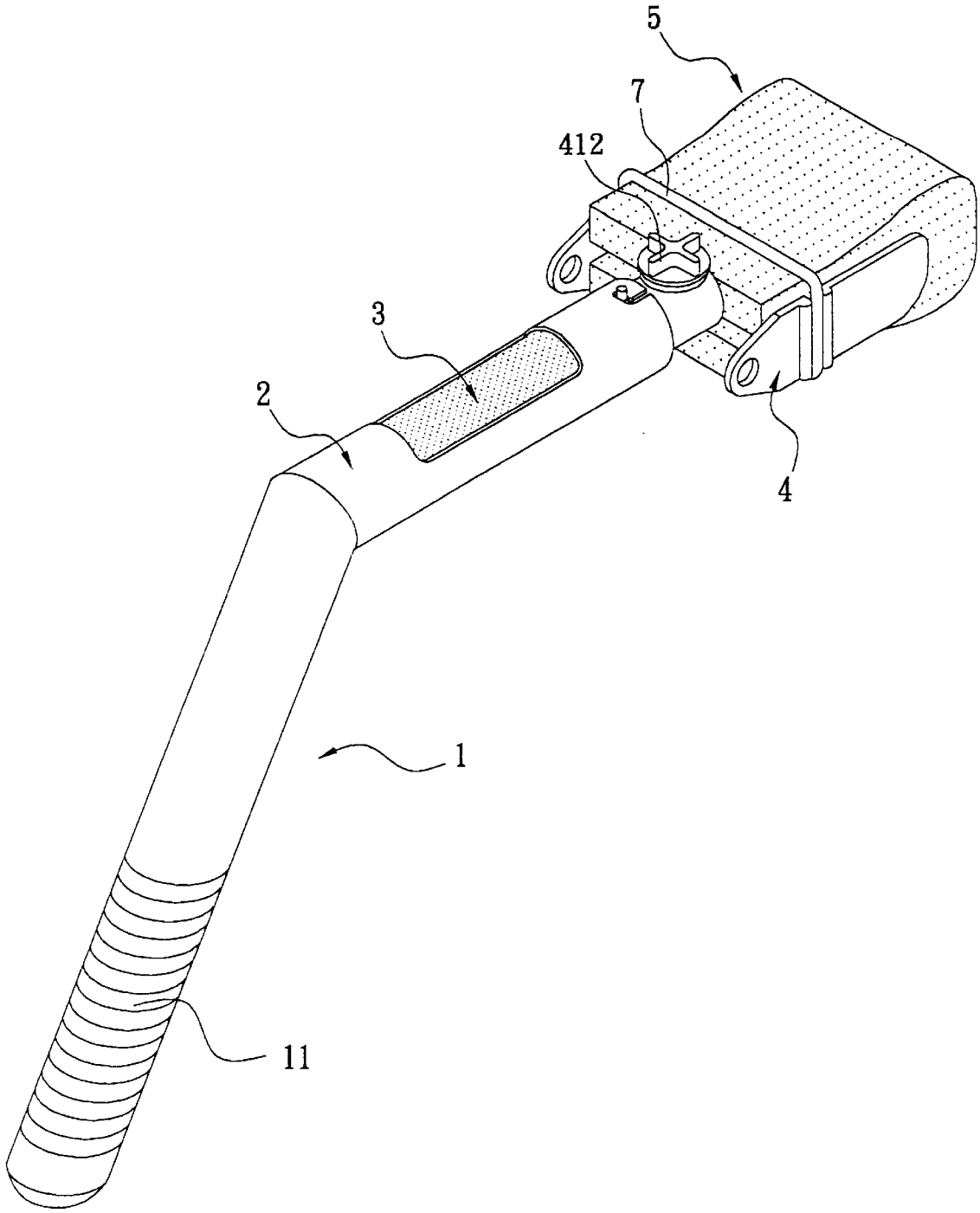
FIG. 1 is an assembled perspective view of a hand-controlled back brush according to a preferred embodiment of the present invention.
Figure 2:
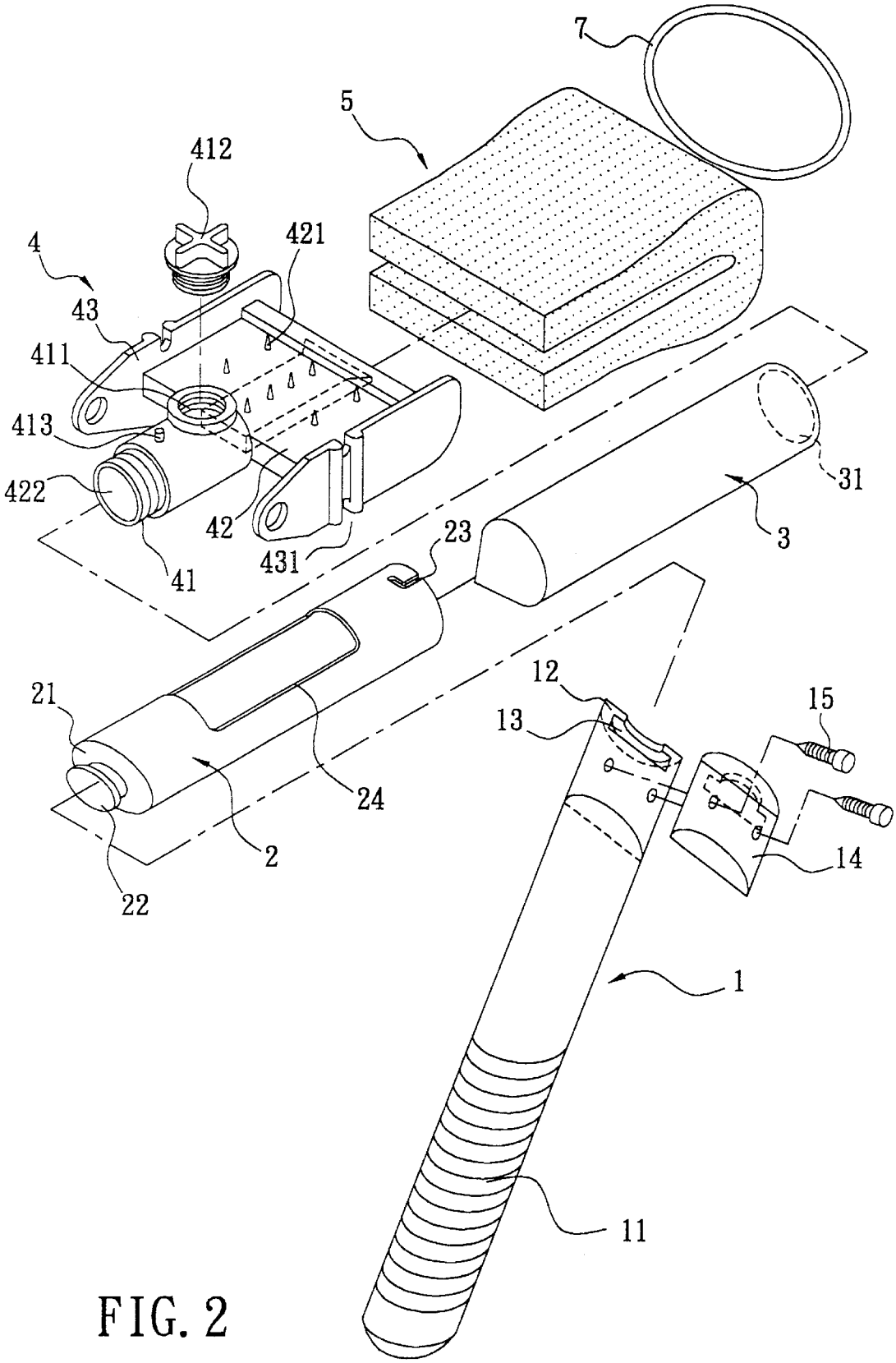
FIG. 2 is an exploded perspective view of FIG. 1.

Please refer to FIGS. 1 and 2 that are assembled and exploded perspective views, respectively, of a hand-controlled back brush according to a preferred embodiment of the present invention. As shown, the hand-controlled back brush of the present invention mainly includes a handle 1, an arm portion 2, a bath cream container 3, a sponge holder 4, and a sponge 5.

The handle 1 is hollow cylinder having a front end that forms a bevel surface 12 having an inclination about 60 degrees, and a rear end provided with a plurality of antislip strips 11 formed from alternate ribs and grooves around the handle 1.

Figure 3:
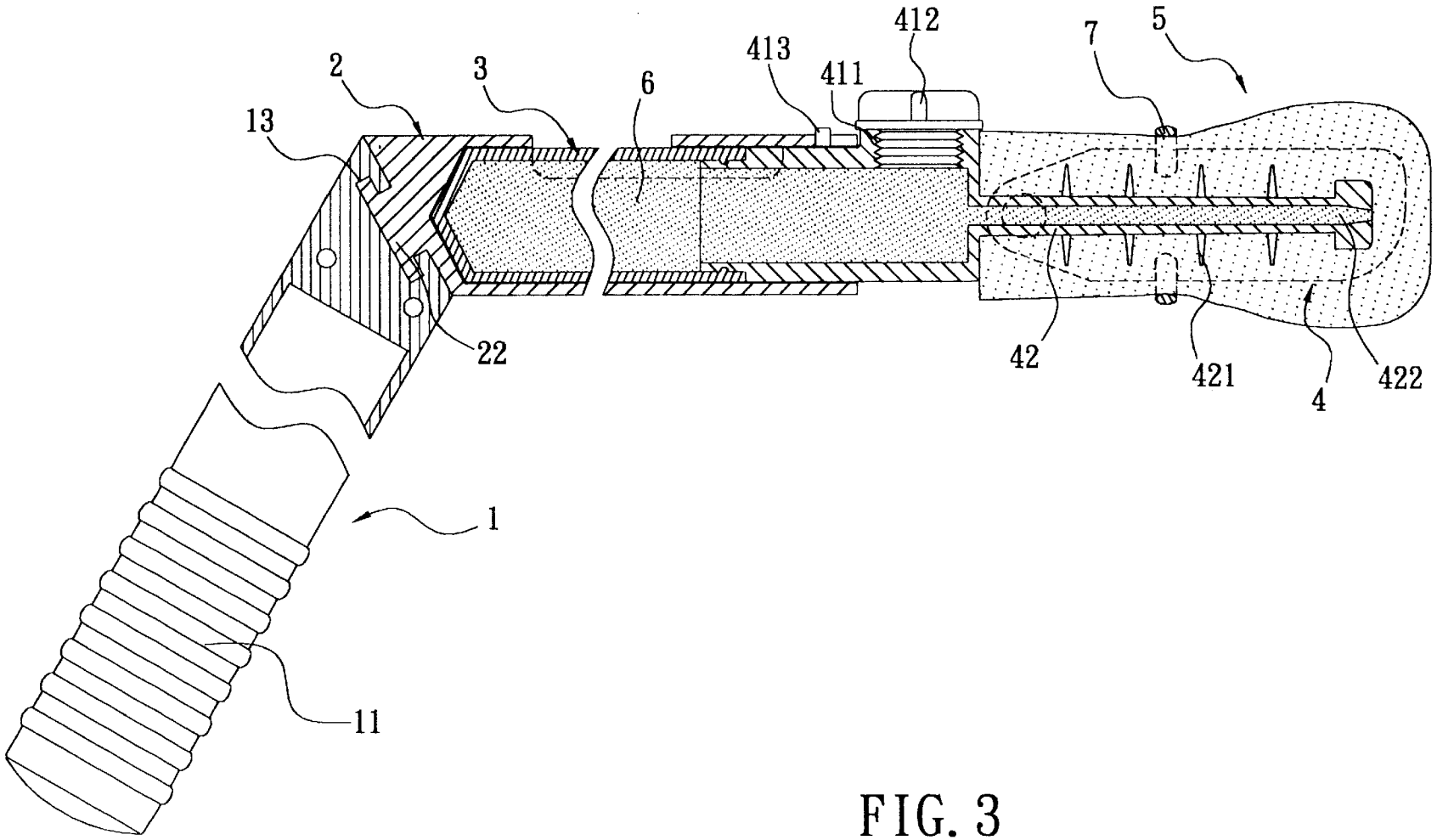
FIG. 3 is a sectioned side view of FIG. 1.
Figure 4A:
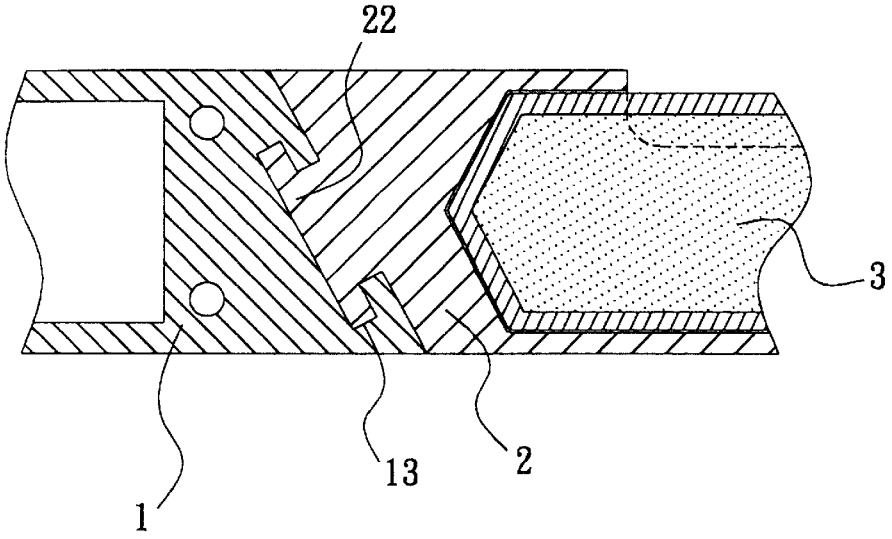
FIG. 4A is a fragmentary and enlarged sectional view showing a movable bevel joint of the hand-controlled back brush of FIG. 1 is in an original position without being rotated.
Figure 4B:
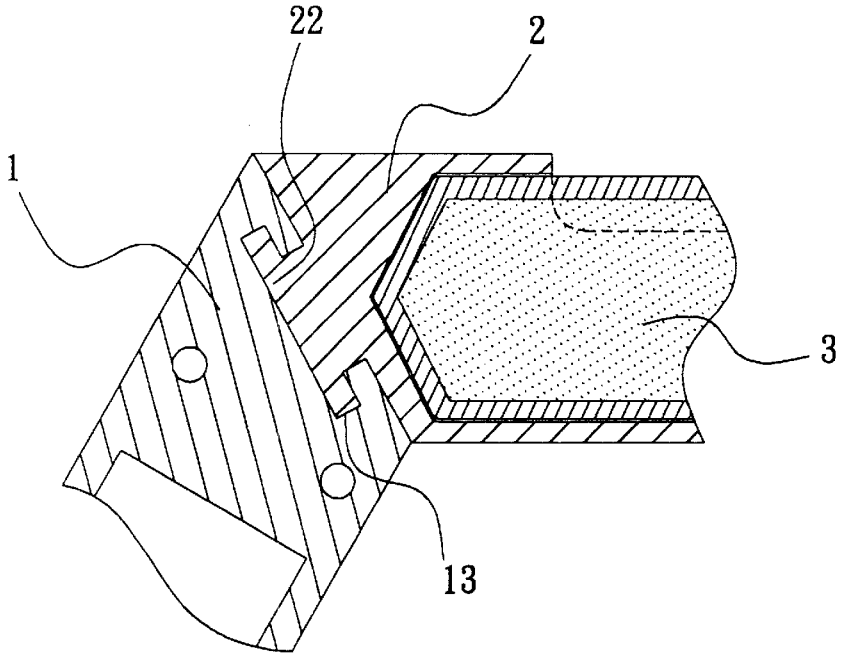
FIG. 4B is another fragmentary and enlarged sectional view showing the movable bevel joint of the hand-controlled back brush of FIG. 1 is rotated by 180 degrees.

The arm portion 2 is also a hollow cylinder having an open front end and a bevel rear end 21 having an inclination about 60 degrees. The bevel front end 12 of the handle 1 and the bevel rear end 21 of the arm portion 2 are connected to each other by way of mortise and tenon joint. Please refer to FIGS. 3, 4A and 4B at the same time. The bevel rear end 21 of the arm portion 2 is provided at a center with a substantially T-sectioned round projection 22 perpendicular to the bevel rear end 21, and the bevel front end 12 of the handle 1 is provided at a center with a substantially T-sectioned round recess 13 perpendicular to the bevel front end 12. Please refer to FIG. 2 again. The T-sectioned round recess 13 includes two halves, namely, a lower half that is integrally connected to the handle 1 and an upper half 14 that may be closed onto the lower half and be locked thereto with fixing screws 15. The T-sectioned round projection 22 on the bevel rear end 21 of the arm portion 2 is fitly and rotatably received in the lower half of the T-sectioned round recess 13 on the bevel front end 12 of the handle 1. After the upper half 14 of the round recess 13 is screwed onto the lower half, the arm portion 2 and the handle 1 are connected and could be rotated relative to one another.

The arm portion 2 is provided at an upper part with a window 24 to expose a part of the bath cream container 3 that is positioned in the arm portion 2, so that a user may conveniently compress the bath cream container 3 via the window 24 with a thumb. The arm portion 2 is also provided at an upper front end with an L-shaped locating slot 23.

The bath cream container 3 is made of a rubber material and has an open front end 31 adapted to connect to a coupling tube 41 provided at a rear end of the sponge holder 4.

The sponge holder 4 has a front end that is a flat rectangular sponge holding plate 42 being provided at an upper and a lower surface with a plurality of stop spikes 421 for holding the sponge 5 to the front end of the sponge holder 4 and preventing the sponge 5 from moving on the sponge holding plate 42. Each of the spikes 421 has a length smaller than a thickness of the sponge 5. Two side plates 43 are connected to two lateral sides of the sponge holding plate 42 to prevent the sponge 5 from moving sideward. Each of the side plates 43 is provided at a rear part with a clamping groove 431 into which a rubber clamp ring 7 is engaged to firmly bind the sponge 5 to the front end of the sponge holder 4, as shown in FIG. 1. An internally threaded hole 411 is provided on an upper part of the sponge holder 4 immediately behind the sponge holding plate 42 to serve as a bath cream inlet, and a nut 412 is normally screwed into the hole 411 to seal the same. As can be clearly seen from FIG. 3, the sponge holder 4 defines therein a passage 422 extended between a rear opening of the coupling tube 41 and a body cream outlet at a front end of the sponge holding plate 42, so that the bath cream container 3 may be compressed to supply an amount of bath cream 6 from the container 3 through the passage into the sponge holding plate 42 to wet the sponge 5. A locating stub 413 outward projects from the coupling tube 41 immediately behind the bath cream inlet 411 to engage with the L-shaped locating slot 23 and thereby connects the arm portion 2 to the sponge holder 4.

To assemble the hand-controlled back brush of the present invention, first connect the open front end 31 of the bath cream container 3 to the coupling tube 41 at the rear end of the sponge holder 4, and then extend a rear end of the container 3 into the arm portion 2. Thereafter, engage the L-shaped locating slot 23 on the arm portion 2 with the locating stub 413 on the coupling tube 41, so that the arm portion 2 is connected to the sponge holder 4. Finally, fix the sponge 5 on the stop spikes 421 of the sponge holding plate 42 by binding it with the rubber clamp ring 7 and engaging the rubber clamp ring 7 with the clamping grooves 431 at two lateral sides of the sponge holding plate 42, and thereby complete the hand-controlled back brush.

To use the back brush of the present invention, first pour an amount of bath cream 6 into the container 3 via the threaded hole 411. Use a thumb to compress the rubber container 3 via the window 24 on the arm portion 2, and the bath cream 6 in the container 3 would be sent under pressure through the passage 422 to the sponge 5 held to the front end of the sponge holder 4. The flow of the bath cream 6 is controlled through the pressure applied by the thumb on the rubber container 3 and the number of times the rubber container 3 is compressed. A user may rotate the handle 1 relative to the arm portion 2 by 180 degrees, so that the handle 1 and the arm portion contain between them an angle of 120 degrees that best enables a user to easily brush his or her back with the back brush of the present invention.

What is claimed is:

1. A hand-controlled back brush, comprising:

a hollow cylindrical handle having a front bevel and provided at a center with a substantially T-sectioned round recess perpendicular to said front bevel end, and a rear end provided with a plurality of antislip strips;

a hollow cylindrical arm portion having an open front end and a rear bevel end that is provided at a center with a substantially T-sectioned round projection perpendicular to said rear bevel end for engaging into said T-sectioned round recess on said front bevel end of said handle; and said arm portion being provided at an upper part with a window and near an upper front end with an L-shaped locating slot;

a hollow cylindrical bath cream container made of a rubber material and having an open front end and a closed rear end, said bath cream container having a size adapted to easily position in said arm portion; and a sponge and a sponge holder being provided at a front end with a flat rectangular sponge holding plate that is provided at upper and lower surfaces with a plurality of stop spikes for holding said sponge to the front end of said sponge holder, at two lateral sides of said sponge holdingplate with two side plates for preventing said sponge from moving sideward, each of said sideplates being provided at a rear part with a clamping groove into which a rubber clamp ring is engaged to firmly bind said sponge to said sponge holding plate, at an upper part immediately behind said sponge holding plate with an internally threaded hole and a nut to serve as a bath cream inlet, and inside said sponge holding plate with a passage extended between a rear opening and a front bath cream outlet of the sponge holder; and said handle and said arm portion being rotatable relative to each other to contain between them an angle best suitable for easy brushing of a user's back; and said rubber bath cream container being compressible with a thumb via said window on said arm portion to supply a controlled flow from said container through said passage to said sponge fixed on said sponge holding plate.

2. The hand-controlled back brush as claimed in claim 1, wherein said handle and said arm portion are freely rotatably connected to each other at said front bevel end of said handle and said rear bevel end of said arm portion.

3. The hand-controlled back brush as claimed in claim 1, wherein said angle contained between said handle and said arm portion best suitable for easy brushing of a user's back is a 120-degree angle.

4. The hand-controlled back brush as claimed in claim 1, wherein each of said plurality of stop spikes has a length smaller than a thickness of said sponge.

5. The hand-controlled back brush as claimed in claim 1, wherein said plurality of antislip strips on said handle include alternate ribs and grooves around said handle.

* * * * *